United States Patent [19]

Zimmermann

[11] Patent Number: 5,008,980

[45] Date of Patent: Apr. 23, 1991

[54] CLOSURE CLIP, ESPECIALLY FOR THE CLOSURE OF BAGS AND A METHOD AND MACHINE FOR APPLYING THE SAME

[76] Inventor: Arnold Zimmermann, 9, chemin des Chênes, 2072 St.-Blaise, Switzerland

[21] Appl. No.: 398,223

[22] Filed: Aug. 24, 1989

[30] Foreign Application Priority Data

Aug. 30, 1988 [CH] Switzerland ..... 3226/88

[51] Int. Cl.[5] ..... B65D 63/00

[52] U.S. Cl. ..... 24/30.5 R; 24/30.5 P; 24/453

[58] Field of Search ..... 24/30.5 R, 30.5 P, 17 A, 24/17 AP, 453, 487

[56] References Cited

U.S. PATENT DOCUMENTS

| | | | |
|---|---|---|---|
| 3,571,861 | 3/1971 | Olson | 24/30.5 P |
| 3,621,539 | 11/1971 | Ayers | 24/30.5 R |
| 3,713,622 | 1/1973 | Dinger | 24/543 |
| 3,766,925 | 10/1973 | Rubricius | 24/543 |
| 3,818,553 | 6/1974 | Parmenter | 24/30.5 R |
| 4,470,173 | 9/1984 | Adamson | 24/30.5 P |
| 4,514,882 | 5/1985 | Lavielle | 24/30.5 P |
| 4,656,697 | 4/1987 | Naslund | 24/30.5 P |

FOREIGN PATENT DOCUMENTS

| | | | |
|---|---|---|---|
| 0139065 | 5/1985 | European Pat. Off. . | |
| 8602618 | 5/1986 | European Pat. Off. | 24/30.5 R |

*Primary Examiner*—Victor N. Sakran

*Attorney, Agent, or Firm*—Marshall, O'Toole, Gerstein, Murray & Bicknell

[57] ABSTRACT

A closure clip, especially for the closure of bags, has a base member with a first and a second leg of plastic material, each of the legs forming a rigid structure having a hinge end and a coupling end portion. The legs are hingedly connected at their hinge ends and provided with first and second snap coupling members, respectively, at their coupling end portions. The coupling end portions with their first and second snap coupling members, respectively are integral to the rigid structure of the respective leg. The snap coupling members are manually engageable to each other and manually releasable from each other only by swivelling the legs about their hingedly connected ends.

14 Claims, 8 Drawing Sheets a
b
c
33'
33
31
10'
10

34'
34

35
35'

CLOSURE CLIP, ESPECIALLY FOR THE CLOSURE OF BAGS AND A METHOD AND MACHINE FOR APPLYING THE SAME

BACKGROUND OF THE INVENTION

The present invention relates to a closure clip for the closure of bags and the like, a method for applying this clip to bags and a machine therefore.

Conventionally, the open end of a bag is closed either by sealing or by applying a clip. In the case of using clips, the clips mostly are metal strips bent around the gathered end of the bag. Such metal clips are widely used, since they can easily be applied and since the clip material on stock is a continuous wire, which before applying is cut into sections.

However, when packaging food into bags, it has absolutely to be avoided that any metal particles are present in the food. Therefore, it is necessary to examine the closed packages with regard to the presence of metal particles. When packages are closed with metal clips, these clips will interfere with metal detectors so that this examination is difficult to be carried out.

DESCRIPTION OF THE PRIOR ART

Therefore, several types of non-metallic clips are known in the art. In U.S. Pat. No. 3,818,553 a non metallic bag closure clip is described having two hingedly connected legs which at their other ends can be closed by means of resilient hooks. However, in the closed state these hooks are not secured since they can be opened without applying any force by merely tilting one of the hooks. Furthermore, the hooks of the known clip comprise projecting parts which easily can damage other bags or interfere with hooks of adjacent bags so that there is a certain danger that they are opened unwillingly. In the closed state the known clip does not form a clearly defined but a variable opening for the gathered end of a bag. For actuating the hook, the legs first have to be approached, thereby reducing the opening. To enable this, the clip can not be dimensioned to fit exactly in its closed state. As a summary, the known clip does not satisfy the requirements of a safe closure for food bags or the like.

Another clip of plastic material is disclosed in European patent publication Nr. 0 139 065. This clip is a safety closure which once opened cannot be closed again, thereby indicating that the package is no longer intact. Therefore, this clip can not be used for repeatedly closing a bag once it has been opened. This, however, is an important feature of clips for closing packages.

SUMMARY OF THE INVENTION

Therefore, it is an object of the invention to provide a clip of plastic material which in its closed state defines an invariable and fixed opening for the packages, which is safely locked against accidental opening and which can be easily opened and repeatedly be closed by the user.

Furthermore, it is an object of the invention to provide a clip which can be equipped with an additional safety seal clearly indicating the first opening of the clip, whereas the clip after said first opening is suited for a further use as a closure which repeatedly can be opened and closed.

Another object of the invention is to provide a clip which can easily be opened by using only one hand, but which is not accidentally opened, all the same.

Still another object of the invention is to provide a clip which does not hook with clips of adjacent packages and which does not damage adjacent packages.

These and still other objects and advantages of the invention will appear in the description and drawings.

BRIEF DESCRIPTION OF THE DRAWINGS

The invention will be described with reference to the accompanying drawings, in which.

DESCRIPTION OF THE PREFERRED EMBODIMENTS

Figure 7:
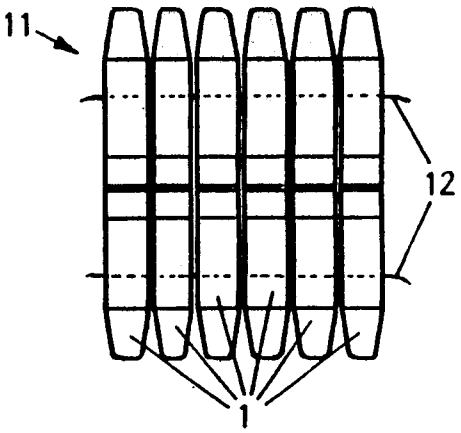
FIG. 7 illustrates a section of a strip comprising a plurality of clips of FIG. 1.
Figure 8:
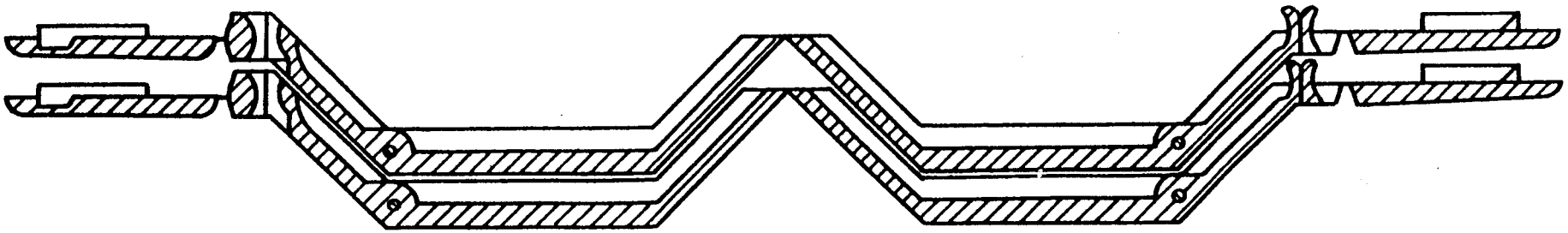
FIG. 8 illustrates a schematic view of two overlying layers of a roll of the strip of FIG. 7.

Referring now, more particularly, to FIGS. 1 to 6 a first embodiment of the clip of the invention is described. In FIGS. 7 and 8 the same clips are shown as a part of a strip or roll, respectively. It has to be understood that in the FIGS. 1 to 6 the clip is shown in enlarged representation, whereas FIG. 7 shows substantially the real dimensions of the clips.

Figure 6:
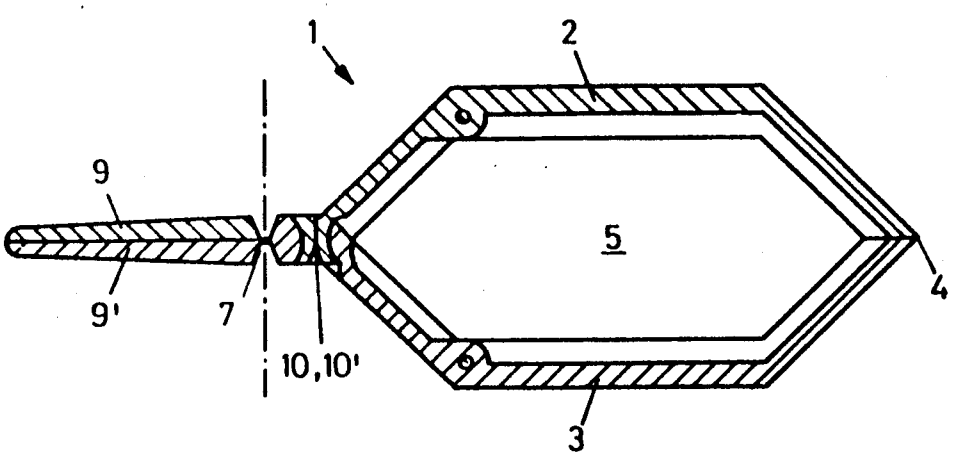
FIG. 6 illustrates a longitudinal section of the clip of FIG. 1 in its closed state.

The clip of these figures, generally indicated by the numeral 1, is a safety clip, which in FIG. 6 is shown in a closed state before it is opened for the first time. Clip 1 comprises two legs 2 and 3, which are hingedly connected at their one ends by a hinge 4. This hinge 4 preferably is formed as a thin and flexible part of the same plastic material as the legs of the clip and is injection molded together with the clip itself. It can also be shaped as a self closing spring hinge or a snapper hinge.

In contrast to the flexible hinge portion 4 the two legs 2 and 3 are substantially rigid, so that in the closed state they form a defined and fixed opening 5 (FIG. 6) for the end of a bag to be closed.

Figure 1:
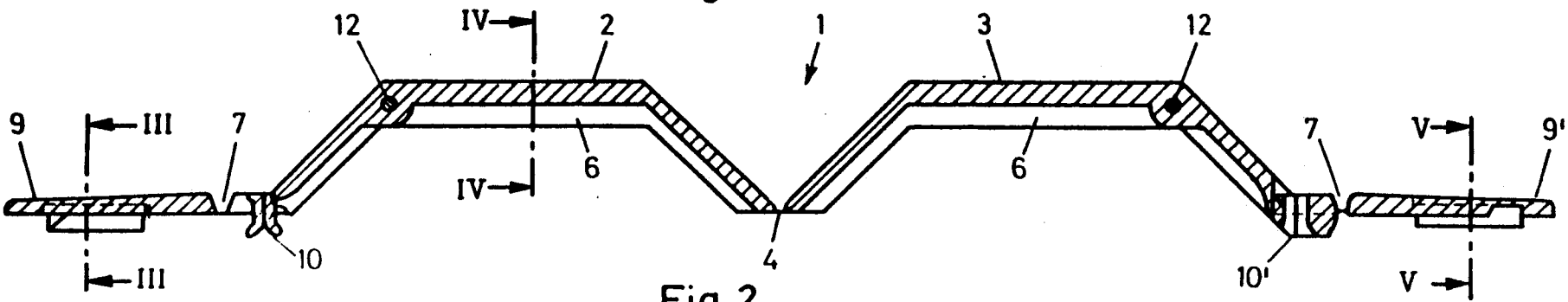
FIG. 1 illustrates a first embodiment of the clip with a security tongue in enlarged representation of a longitudinal section in its open state.
Figure 2:
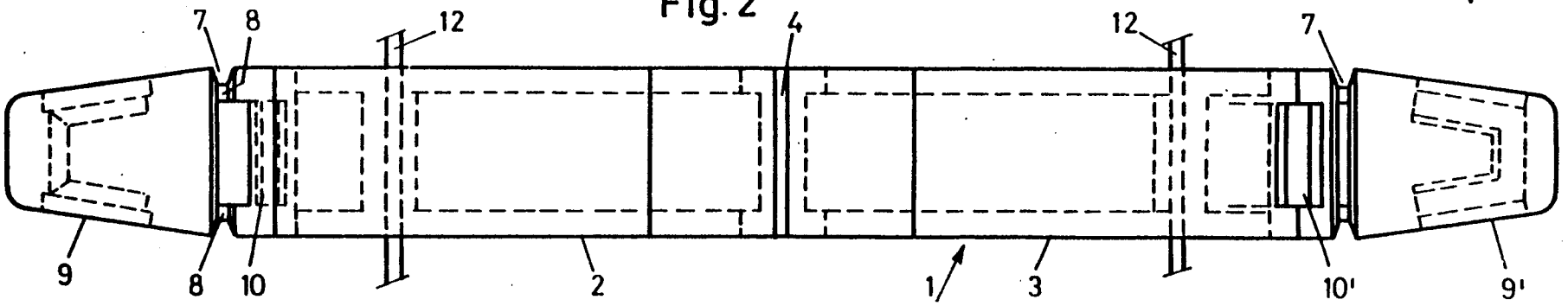
FIG. 2 illustrates a plan view on the clip of FIG. 1.
Figure 5:
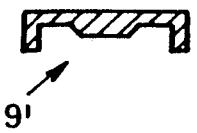
FIG. 5 illustrates a sectional view along line V—V in FIG. 1.
Figure 4:
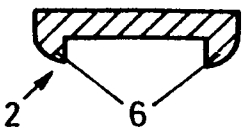
FIG. 4 illustrates a sectional view along line IV—IV in FIG. 1.
Figure 3:
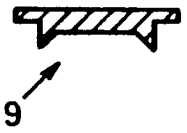
FIG. 3 illustrates a sectional view along line III—III in FIG. 1.

The legs 2,3 have a trapezoidal shape as can be seen from FIG. 1. In the closed state (FIG. 6) they form an opening 5 of hexagonal shape enclosing the gathered end of a bag to be closed. The dimensions of the legs are adapted to the kind of bag to which the clip is applied. It is important that the closed clip 1 sits safely on the neck of the bag thereby avoiding any possibility to strip the clip off the end of the bag. The legs 2,3 are provided with stiffening ribs 6 at their inner surface, which ribs 6 also are provided for increasing the adhesion of the closed clip 1 relative to the bag. The ribs 6 are pressed into the gathered bag when the clip is closed.

As already mentioned, the clip of FIGS. 1 to 6 is a safety closure, as will be described in more detail later. Though for a first opening, a safety tongue 9 has to be removed, the clip can be closed manually and reopened afterwards. Therefore it can fully be used as a closure even after the first opening. For enabling such repeated use, there are snap coupling means 10,10' at end portions of the legs 2,3 opposite to the hinge 4. At leg 2 a plug member 10 is provided, which fits with a socket member 10' at the other leg 3, when the clip 1 is closed (FIG. 6). In this closed state the end portions of the legs firmly rest against each other. The plug and socket members 10,10' together form a snap coupling which can be opened and closed manually against a defined snapping force merely by swivelling the legs 2,3 about their common hinge 4. The snapping force necessary to open the clip is bigger than the expansion force of the gathered end of the bag, so that there is no danger of self-opening of the clip. For manually applying the opened clip to the gathered bag, it is sufficient to press the legs 2,3 together against the snapping force, which easily can be done by using two fingers of one hand. For reopening the clip 1 the two leg 2,3 merely have to be pulled outwardly.

Instead or in addition to this snap coupling, the hinge 4 can be a self closing type hinge, which exerts a closing force onto the legs 2,3 to urge them in a closed relationship unless they are pulled outwardly.

The outer surface of the trapezoidal legs 2,3 preferably form flat surfaces which can be printed on. E.g. the brand name of a product or any other information can be printed on this surfaces. Furthermore, the flat, trapezoidal outer surface of the legs allow their use with a clipping machine for automatically applying the clips to bags as will be described later.

What was described so far, is a base model for several further clip embodiments. The two rigid hinged legs 2,3 which are integral with the snap coupling means 10,10' at their outer ends form this base model which will be present also in all other embodiments. Therefore, this base model needs not be described in connection with each further embodiment. It can be provided with different additional features, which will be explained furtheron. Therefore, for injection molding the same mold can be used at least for the base model of several embodiments.

In the embodiment of FIGS. 1 to 8, said base model is provided with additional safety tongue members 9,9'. At each leg 2,3 a safety tongue member 9,9' is formed and connected thereto via two webs 8 of reduced cross section. In the closed state of the clip the safety tongue members 9,9' are undetachably connected together, e.g. by welding or melting them together by means of ultrasonic welding, as can be seen from FIG. 6.

The webs 8 then together form a breaking point 7 at which the connected tongue members 9,9' can manually be severed from the base model. The closed clip 1 therefore can not be opened unless the undetachably connected tongue members 9,9' have been severed at the breaking point 7, as is indicated in FIG. 6 by a dotted line. When the tongue members 9,9' are removed, there are still the snap coupling means 10,10' which are not influenced thereby and after a first opening serve as releasable lock for the clip. Since the presence or absence of the tongue members 9,9' indicates, whether or not the clip has been opened a first time, the tongue members 9,9' function as a safety feature. If e.g. the tongue members 9,9' at a clip 1 are lacking this is an indication that the bag may have been opened before. Such bags therefore can easily be detected by the staff or the customer.

The removable tongue members 9,9' of the closed clip together form a grip for two fingers. For removing the tongues 9,9' this grip can be manually turned off at the breaking point 7. The clip then can be opened against the force of the snap coupling 10,10' as described before.

The shape of the removable tongue members 9,9' can vary for different embodiments. Especially, their undetachable connection can be accomplished in other ways, as will be seen when the description proceeds.

The clip of FIGS. 1 to 6 is a safety closure and at the same time can repeatedly be used after a first opening. It can be easily applied to the bag and removed by a swivelling movement about the hinge 4 which makes it especially suited for automatic packaging machines. In such machines the clips can be processed in the form of a plurality of individual clips or as a strip of interconnected clips. Part of such a strip 11 of clips 1 is shown in FIG. 7. The clips 1 are connected by means of two parallel yarn wires 12, transversely extending through each of the legs 2,3 of the clips (see also FIG. 1). The wires 12 are arranged at the outer corners of the trapezoidal legs 2,3 and thereby provide for a stable and flat strip of open clips 1. They are injection molded onto the two parallel wires 12 with slight mutual clearance, so that the strip can be rolled and there is a gap for severing the clips from the strip by cutting the wires 12. When injection molding the clips the wires 12 stepwisely are moved and guided through the mold serving as a support for the clips which then sectionwisely are injection molded onto the continuous and stepwisely moved wires 12.

The strip 11 of clips 1 formed thereby is rolled on itself, as already mentioned. The trapezoidal shape of the legs 2,3 is such that the layers of such roll are self-centering and that a roll of uniform thickness is formed. In FIG. 8 two overlaying layers of such roll are schematically shown. As can be seen, the legs of adjacent clip layers fit into one another so that there is substantially no interspace therebetween and that the hinges between the legs are blocked. Therefore, a very stable and compact roll is formed which is important for the transport and the use of clips in packaging machines. In packaging machines the strip 11 is turned off the described roll. In each step of the machine the foremost clip of the strip is severed from the strip and is introduced into a clip applying device which gathers the end of a bag and applies a clip as will be described in more detail.

Of course there are other possibilities to interconnect the clips to a strip. Several clips e.g. could be connected in their longitudinal direction. Instead of rolls, the strips could also be stacked in flat layers.

As can be seen from the description, the clip of the invention is especially suited to be applied by means of a clip machine, since it has a clearly defined simple shape and is comprised of only two sections, which are rigid as such and connected by only one flexible hinge. Since the rigid legs unvariably define the shape of the opening 5 of the clip, the clip be handled easily by a machine.

The legs of other embodiments of the invention are not necessarily trapezoidal, but can have a semi-circular or semi-oval shape, as well. The two legs thereby need not to be shaped identically. However, they should be rigid as such.

Figure 9:
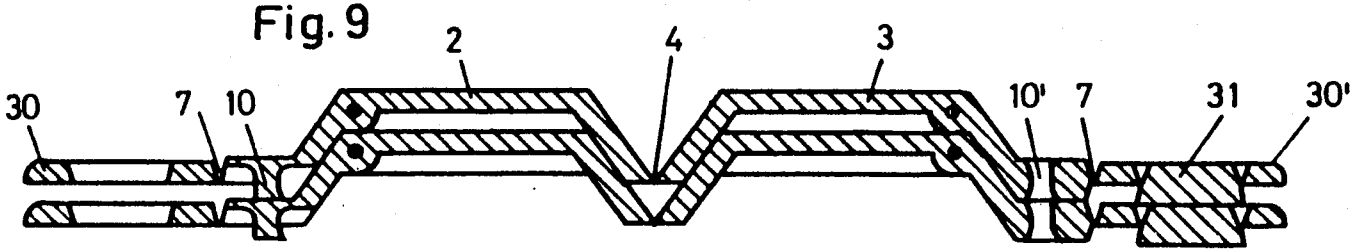
FIGS. 9,10, and 11, illustrate a second embodiment of the clip of the invention with a security seal in sectional view in the open state and in the closed state, and in plan view, respectively.
Figure 10:
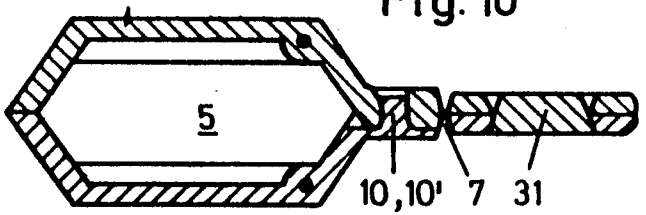
Figure 11:
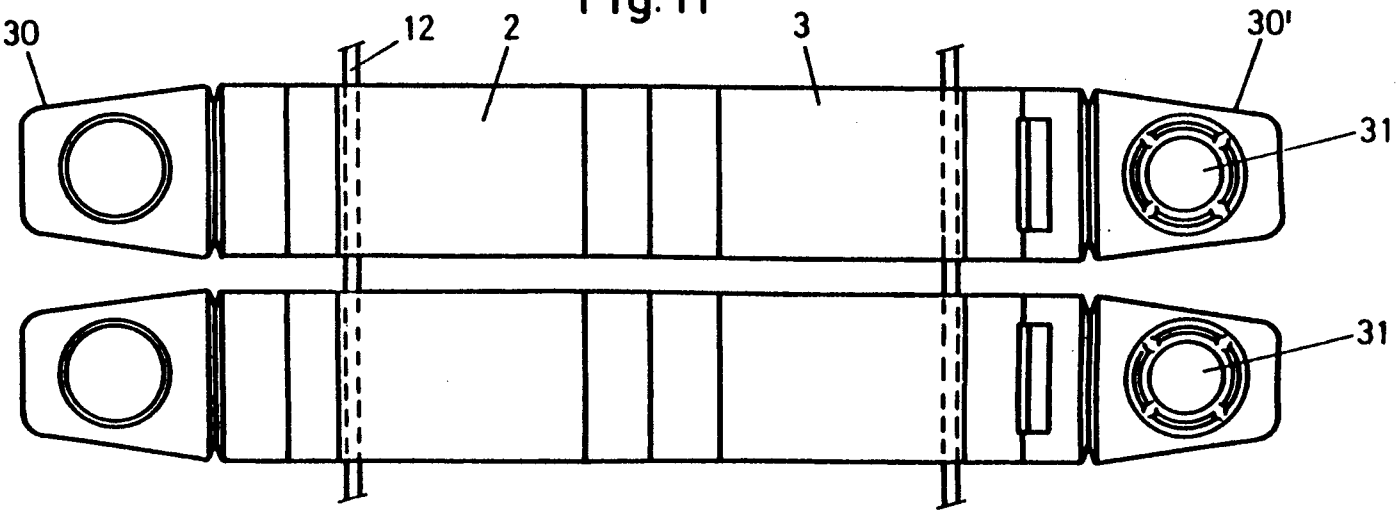

Referring now to the FIGS. 9 to 11 a second embodiment of the clip of the invention is described. In this embodiment only the tongue members 30,30' differ from the previous embodiment, whereas all other features are the same and need not to be described again. The tongue members 30,30' together provide for a safety closure in that they are undetachably connectable, when the clip is closed the first time. One of the tongue members 30' comprises a central seal portion 31 which is connected to the peripheral portion of the tongue member 30' by means of four webs which are of reduced cross section and form breaking points. The central seal portion 31 is pressed into a central hole 31' of the other tongue member 30 when the clip is closed. Since the seal portion 31 as well as the hole 31' have conically shaped walls, they can not be released unless the central seal portion 31 is removed at the breaking points from the tongue member 30'. Therefore, if somebody tries to open the safety closure by separating the two tongue members 30,31, the seal portion 31 will drop out, which clearly indicates the manipulation. The ordinary way to open the clip 1 is to tear off the connected tongue members 30,30' at the breaking point 7, whereafter the clip can be open as already described.

The clip of the present embodiment has the advantage that it indicates any attempt to open the clip without removing the safety closure tongues.

Figure 12:
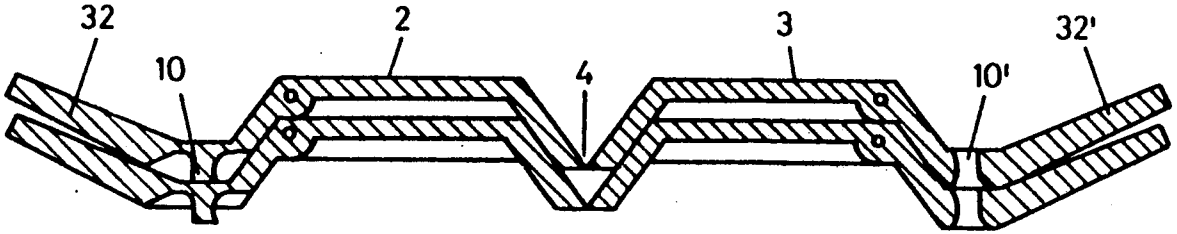
FIGS. 12,13 and 14 illustrate a third embodiment of the invention without security tongue but with an opening aid in a sectional view in the open and closed state, respectively, and in plan view.
Figure 13:
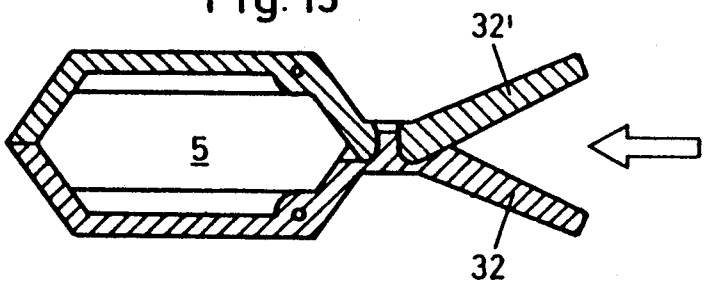
Figure 14:
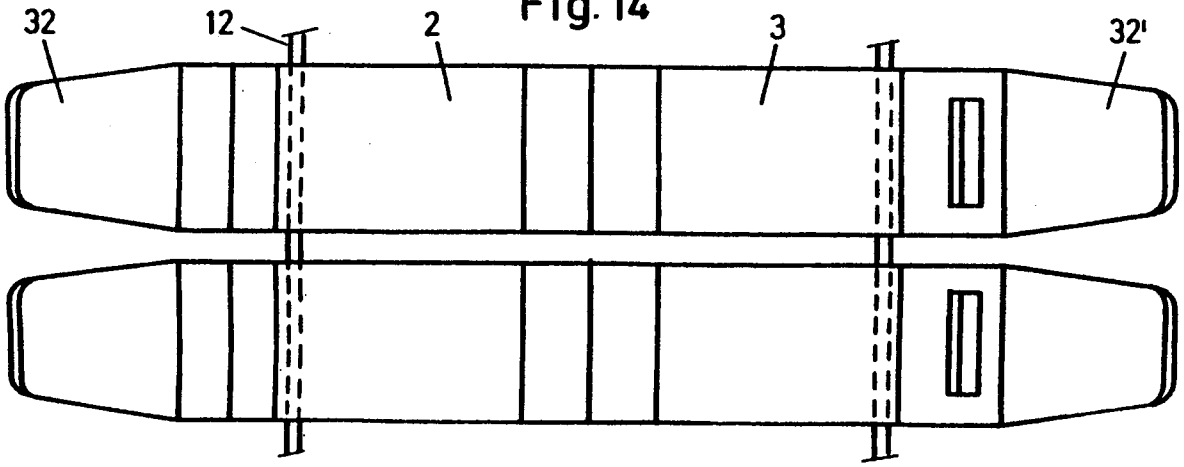
Figure 15:
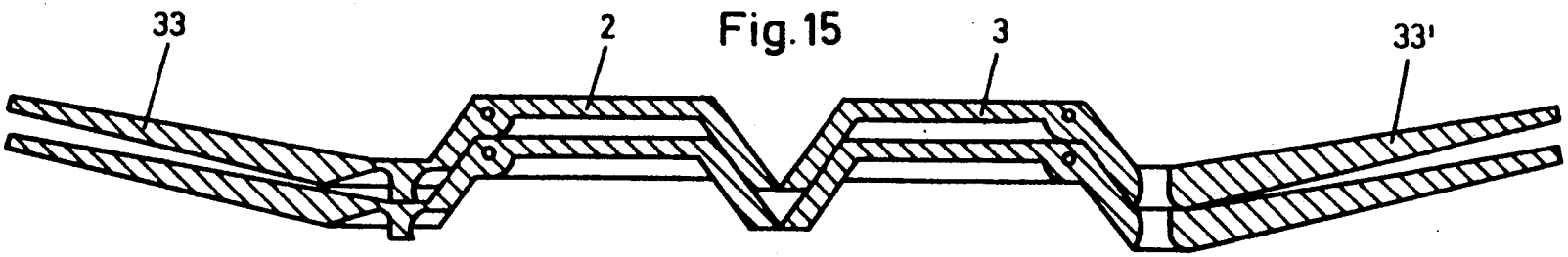
FIGS. 15,16,17 and 18 illustrate a fourth embodiment of the invention, with a changed opening aid, in a sectional view in the open and closed state, respectively and in plan view in the open and closed state, respectively.
Figure 16:
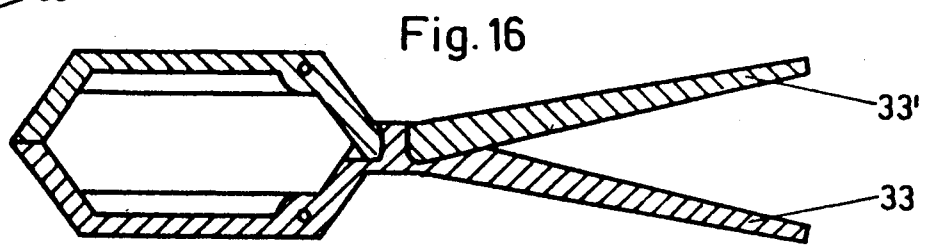

In the FIGS. 12 to 14 a third embodiment of the invention is disclosed which does not comprise safety closure tongues but instead is provided with two rigid seizing sections 32,32 as an opening and closing aid for the clip. The base model of the clip is the same as already described. Adjacent to the snap coupling means 10,10' each leg 2,3 has a seizing section 32,32' rigidly formed to and inseparable from the respective leg. Consequently, leg 2 forms a rigid element together with seizing section 32'. The seizing sections 32,32' extend in an angle relative to the legs. In the closed state of the clip 1 they extend in V-shape relative to each other as is seen from FIG. 13. The clip can be opened merely by pressing a finger between the two seizing sections 32,32' as indicated by an arrow in FIG. 13. To close the clip the two seizing sections 32,32' are manually pressed towards each other so that the plug member 10 snaps into the socket member 10'. The force acted on the seizing sections is transmitted to the snap coupling means since the seizing sections 32,32' are rigid parts of the legs of the clip. This type of clip also can be combined to a strip interconnected by yarn wires 12 (FIG. 14), which strip can be rolled with substantially no interspace between the layers of the roll (FIG. 12).

Figure 18:
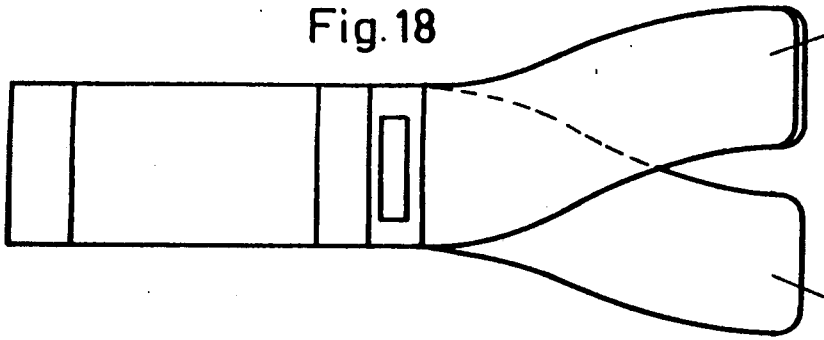
Figure 17:
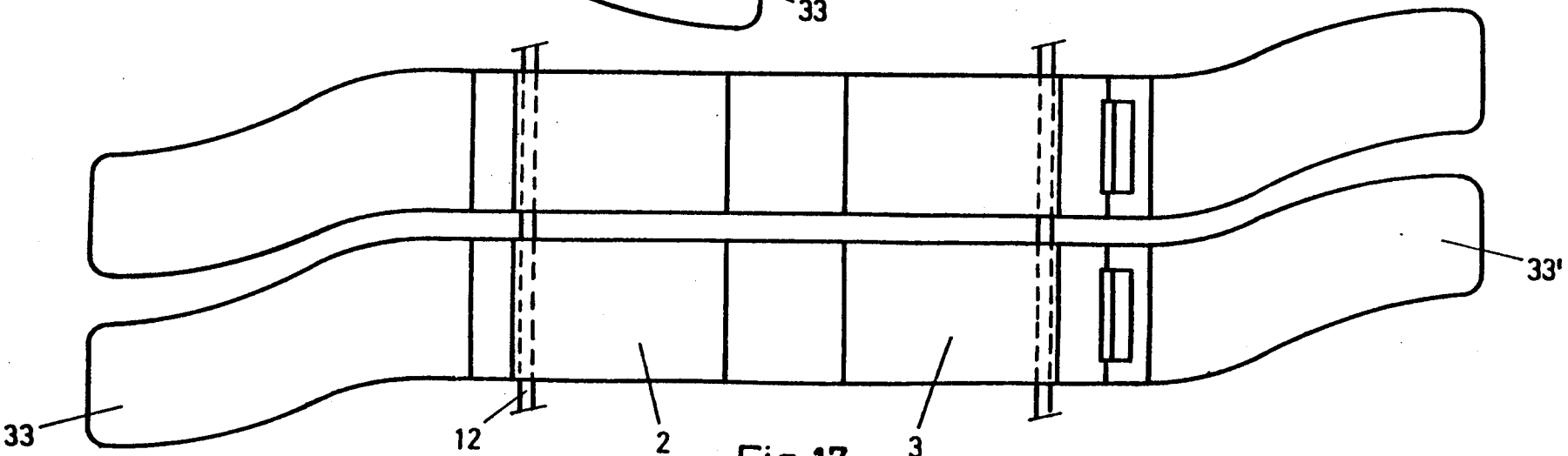

FIGS. 15 to 18 disclose a clip which is a modification of the clip of the FIGS. 12 to 14 in that rigid seizing sections 33,33' provided as an opening and closing aid are laterally displaced to each other in plan view (FIG. 18). The seizing sections 33,33' provide for non-overlapping areas which more easily can be seized for opening and closing the clip. They can rigidly be formed to the legs 2,3 of the clip or can as well be flexible as will be explained in connection with FIG. 21. The laterally displaced seizing sections 33,33' in addition may be shaped to provide for a decorative effect when the clip is closed. Each section e.g. can be shaped as one half of a shamrock or of a heart etc., so that in the closed state of the clip the seizing sections 33,33' together form a shamrock or a heart etc.

Figures 19, 20, 21, 22:
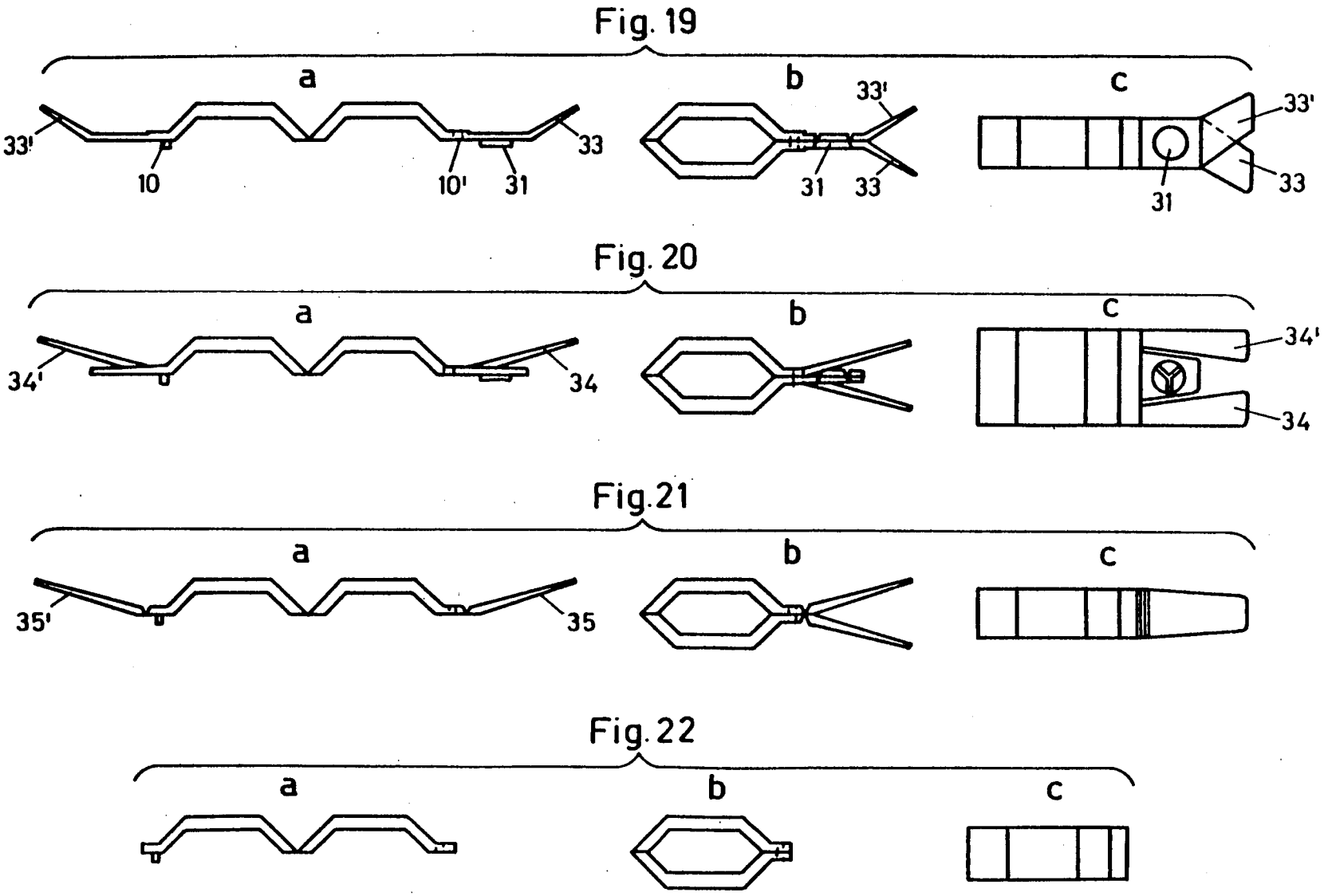
FIGS. 19,20,21,22 show several further embodiments of the clip of the invention, each in a sectional view in the open and closed state and in a plan view in the closed state.

FIGS. 19 to 22 represent further possible embodiments of clips comprising the explained features in different combinations. In every figure a clip embodiment is shown in an open and closed position in side view as well as in a closed position in plan view. In FIG. 22 a to c only the mentioned base model is shown, which is common to all other embodiments.

Referring to the embodiment of FIG. 19 a central seal portion 31 is combined with laterally displaced seizing sections 33',33, which are provided as opening and closing aid. This clip therefore forms a safety closure sealed by means of the central seal portion 31 as described in connection with FIGS. 9 to 11. When the clip is opened the first time by pulling the seizing sections 33',33 outwardly, the central seal portion 31 drops out and the clip can be opened. The missing seal portion 31 then indicates that the clip has already been opened. The clip of FIG. 19 can be closed again and reopened by means of the snap coupling 10,10'. In contrast to the embodiment of FIG. 9, the seizing sections 33',33 remain at the clip even after a first opening.

In FIG. 20 a clip also forming a safety closure, is shown having two lateral seizing tongues 34,34', which are arranged sidewardly of a safety tongue member with a central seal portion 31. If this clip is opened for the first time by pulling the seizing tongues 34,34' outwardly, the central seal portions 31 is released as already described and drops out. The clip can be closed again and reopened as described in connection with the other embodiments.

Finally, FIG. 21 disclose a clip having flexible seizing sections 35,35' formed to the base model. For opening the clip the seizing sections 35,35' are pulled outwardly and for closing it the rigid legs of the clip are pressed together.

All these clips are suited to be connected on strips wherein the yarn wire extends through the legs 2,3 of the base model as shown in FIG. 1. All these clips also are suited to form rolls with centered layers and substantially no interspace between the layers. The clips are of plastic material and are formed by injection molding.

Figure 23:
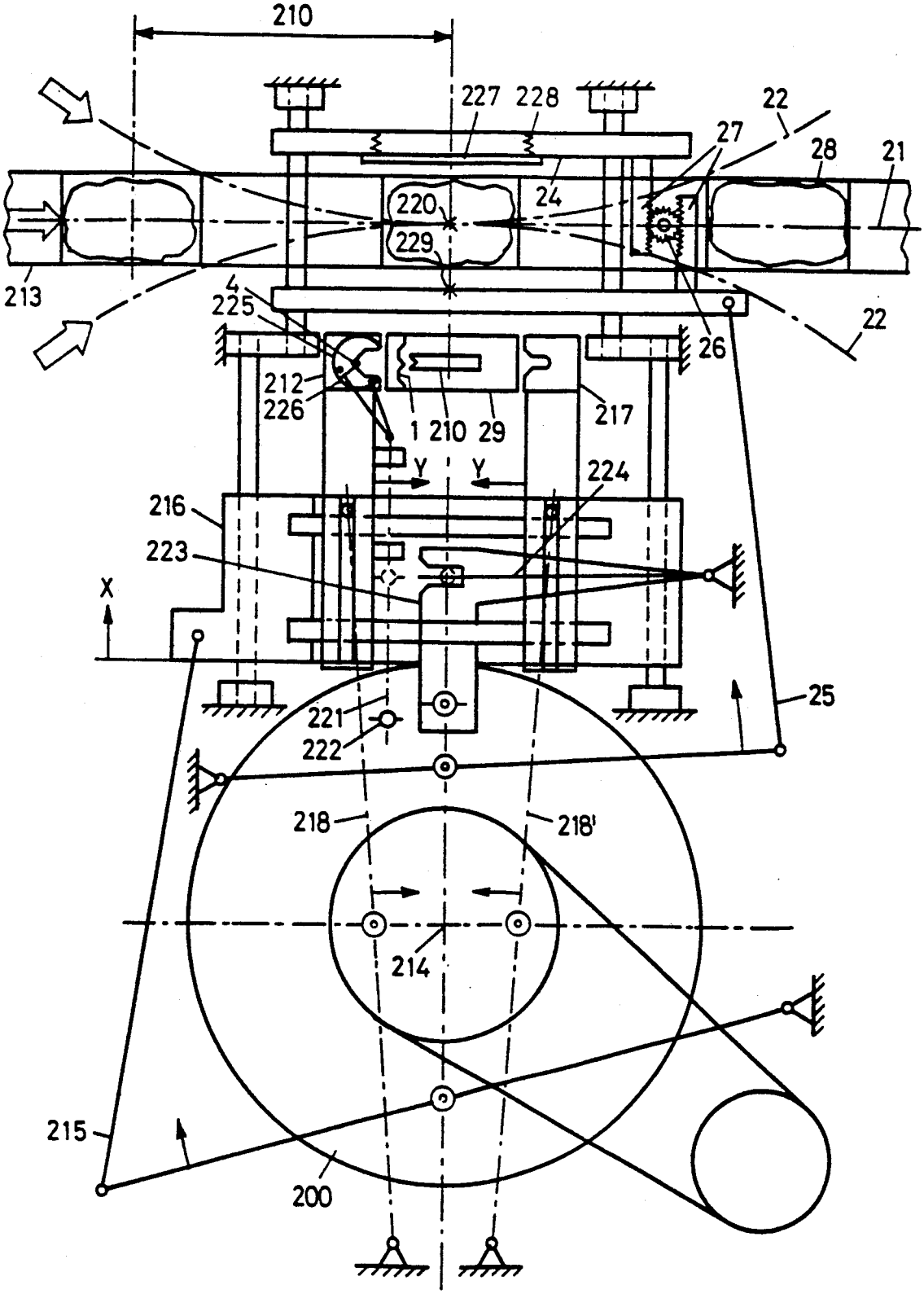
FIG. 23 is a schematic representation of a device for applying the clip of the invention to the end of bags.

These clips are especially advantageous for being applied by means of a clip machine which is part of a package machine. FIG. 23 schematically shows a first embodiment of a clip machine for handling to clips of the invention, wherein all driving units especially a cam plate 200 are exhibited only schematically.

The filled bags 28 are transported by means of a chain bucket conveyor 213 along a straight path 21 or a curved path 22,22' to a closing station 220. The conveyor 213 is operated stepwisely and is a separate unit with own driving means (not shown). The filled bags 28 are conveyed to the closing station 220 with their upper ends opened. In a first phase the open end of the bag at the closing station is flattened by means of two plates 23,24, which are connected via a rotatable gear wheel 26 and are driven by means of a cam drive 25 to move towards each other to the center line 21 of the conveyor path. Between these plates 23,24, the end of the bag is flattened on the center line 21, i.e. in the center of the bag.

One of the plates 24 may comprise a spring-suspended front member 227. The front member 227 is supported by means of adjustable springs 228 on plate 24. By adjusting the springs the force can be adjusted by which the flattened end of the bag is held between the plates 23,24, which in turn influences the shape and quality of the ruche formed by the bag material above the clip.

The flattened bag end then is gathered at a height at which the clip is applied. For gathering the flattened bag and for applying the clip two gathering jaws 212,217 are provided. The first gathering jaw 212 comprises two clip holder dies 225,226 which are hinged about an axis 4.

Before performing said flattening and gathering step, however, a clip 1 is severed from the clip string (not shown) by means of a clip severing unit 29. The clip severing unit 29 comprises a plunger 210 by which the severed clip 1 is introduced into the open clip holder dies 225,226 of the gathering jaws 212. This is done simultaneously with the transporting of a bag to the closing station so that the gathering jaws 212,217 are ready, when the bag end is flattened.

The gathering jaws 212,217 are mounted on a carriage 216 which is driven by means of a cam drive 215 to move into the conveyor path 21 after the bag has arrived at the closing station.

When the plates 23,24 close, the carriage 216 is moved into the conveyor path 21 and the gathering jaws 212,217 are moved towards each other by means of cam drives 218,218' to gather to flattened bag end in the center of the bag. When carriage is in its extended position and the gathering jaws 212,217 are closed, a rod 221 having a bilt 222 is engaged by a jack 223. The jack 223 then is moved towards the closing station by means of a cam drive 224, whereby the rod 221 closes said clip holder dies 225,226. As a consequence the clip 1 contained in the clip holder dies is swiveled about its hinge 4 and closed around the gathered end of the bag.

The dies 225,226 are swiveled about a common hinge 4 which coincides with the hinge 4 of the clip. Each of the two legs 2,3 of the clip 1 thereby is held by one of said dies 225,226 and are pressed towards each other so that the snap coupling means 10,10' as well as the seals forming the safety closing are connected and closed (see FIG. 10).

When the clip 1 is closed, the clip holder dies are opened again by means of the cam drive 224 and the carriage 216 with gathering jaws is moved back into its initial position shown in FIG. 23. Then, the described cycle is repeated for the next bag.

Figure 24:
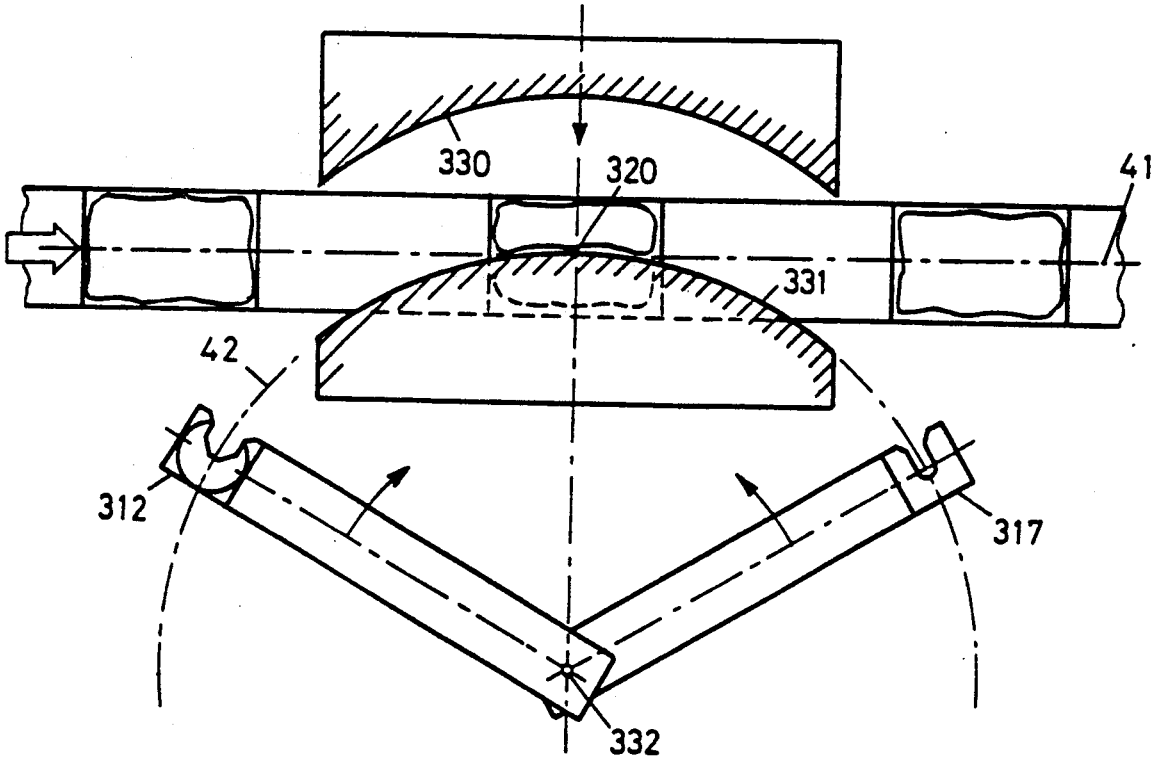
FIG. 24 is a schematic representation of a second embodiment of the device for applying the clip of the invention.

As a modification of the described clip machine of FIG. 23, a circular arrangement of the flattening plates and the gathering jaws is shown in FIG. 24. A fixed plate 331 has a convex periphery defining a circular path 32 with a center 32.

A movable plate 330 of concave periphery of the same radius is moved towards the fixed plate 331 for flattening the end of a bag to be closed as described before. The gathering jaws 312,317 then are driven to swivel about the center 332 and to gather the flattened end of the bag as already described. One of the jaws 312 comprises two clip holding dies as described which are closed when the jaws arrive at their closing position 320 thereby applying the clip to the gathered end of the bag.

Though the clip of the invention hereinbefore was described in connection with the closing of bags it can as well be used for fixing other articles. For such applications the shape of the legs 2,3 of the clip especially at their inner periphery can be adapted to the article to be fixed.

While there are shown and described present preferred embodiments of the invention, it is to be distinctly understood that the invention is not limited thereto, but may be otherwise variously embodied and practiced within the scope of the following claims.

What is claimed is:

1. A closure clip, especially for the closure of bags, comprising a base member with a first and a second leg of plastic material, each of said legs forming a rigid structure having a hinge end and a coupling end portion, said first and second legs being hingedly connected at their hinge ends and provided with first and second snap coupling means, respectively, at their coupling end portions, said coupling end portions with their first and second snap coupling means respectively being integral to said rigid structure of the respective leg whereas said first and second snap coupling means are manually engageable to each other and manually releasable from each other only by swivelling said legs about their hingedly connected ends, wherein each leg at its coupling end portion is provided with a tongue member extending from said coupling end portion into a direction substantially opposite to said hinge end of the respective leg, each of said tongue members being connected to the respective coupling end portion by means of a web forming a breaking point and wherein said tongue members in a closed state are undetachably connected to each other and are detachable together from said coupling end portions at said breaking point.

2. The closure clip of claim 1, wherein when said snap coupling means are in an engaged position said coupling end portions of said first and second leg rest against each other.

3. The closure clip of claim 1, wherein said legs are of substantially identical trapezoidal shape.

4. The closure clip of claim 1, wherein said legs are shaped such that several clips in an opened state are stackable one upon the other, said legs of adjacent clips thereby leaving substantially no free interspace between each other.

5. The closure clip of claim 1, wherein said legs are of substantially identical circular shape.

6. The closure clip of claim 1, wherein said legs are of substantially identical oval shape.

7. A strip comprising a plurality of closure clips as defined in claim 1, wherein said closure clips are arranged in laterally adjacent relative position and are interconnected by means of at least one flexible yarn wire extending transversely through one of said legs of said closure clips.

8. A closure clip, especially for the closure of bags, comprising a base member with a first and a second leg of plastic material, each of said legs forming a rigid structure having a hinge end and a coupling end portion, said first and second legs being hingedly connected at their hinge ends and provided with first and second snap coupling means, respectively, at their coupling end portions, said coupling end portions with their first and second snap coupling means respectively being integral to said rigid structure of the respective leg whereas said first and second snap coupling means being manually engageable to each other and manually releasable from each other only by swivelling said legs about their hingedly connected ends, wherein each leg at its coupling end portion is provided with a tongue member extending from said coupling end portion into a direction substantially opposite to said hinge end of the respective leg, wherein said tongue members are provided with a central seal portion for coupling the two tongue members in a closed state, said central seal portion being connected to one or both of said tongue members by means of central webs therein forming breaking points, which when separating said tongues from each other are broken so that said central seal portion is released from said tongue members.

9. The closure clip of claim 8, wherein when said snap coupling means are in an engaged position said coupling end portions of said first and second leg rest against each other.

10. The closure clip of claim 8, wherein each of said tongue members is rigidly formed to said coupling end portion of the respective leg, whereas each of said rigid tongue members had a seizing section which in a closed state of the clip is free from the seizing section of the other tongue member, so that each of said seizing sections can be manually seized to swivel said legs for releasing said snap coupling means.

11. The closure clip of claim 10, wherein in a closed state of the clip said tongue members extend in V-shape relative to each other.

12. The closure clip of claim 8, wherein said two legs are of substantially identical trapezoidal shape.

13. The closure clip of claim 8, wherein said legs are shaped such that several clips in an opened state are stackable one upon the other, said legs of adjacent clips thereby leaving substantially no free interspace between each other.

14. A strip comprising a plurality of closure clips as defined in claim 8, wherein said closure clips are arranged in laterally adjacent relative position and are interconnected by means of at least one flexible yarn wire extending transversely through one of said legs of said closure clips.

* * * * *